US006611977B1

(12) United States Patent
Schuman et al.

(10) Patent No.: US 6,611,977 B1
(45) Date of Patent: Sep. 2, 2003

(54) FRAME APPARATUS

(76) Inventors: Ethan Joel Schuman, 915 Golf Course Dr., University City, MO (US) 63132; William Vernon Koeneker, 12852 Vista Ridge, St. Louis, MO (US) 63138

( * ) Notice: Subject to any disclaimer, the term of this patent is extended or adjusted under 35 U.S.C. 154(b) by 0 days.

(21) Appl. No.: 09/495,051

(22) Filed: Jan. 31, 2000

(51) Int. Cl.[7] ..... A47C 19/00

(52) U.S. Cl. ..... 5/200.1; 5/201; 5/202; 5/282.1; 5/285; 5/286; 29/897; 29/897.31

(58) Field of Search ..... 5/200.1, 201, 202, 5/203, 282.1, 285, 286; 29/525.01, 897, 897.31, 897.312; 72/181, 182, 131

(56) References Cited

U.S. PATENT DOCUMENTS

| | | | | | |
|---|---|---|---|---|---|
| 971,688 | A | | 10/1910 | Row | |
| 1,413,918 | A | * | 4/1922 | Lamb | 29/897 |
| 1,670,055 | A | | 5/1928 | Trimble | |
| 1,676,222 | A | | 7/1928 | Sheldon | |
| 1,772,780 | A | * | 8/1930 | Milone | 29/897 |
| 1,800,793 | A | | 4/1931 | Harms | |
| 2,040,995 | A | | 5/1936 | Holt | |
| 2,450,723 | A | * | 10/1948 | Elrad | 29/897 |
| 2,648,073 | A | * | 8/1953 | Nowell | 5/200.1 |
| 2,706,300 | A | * | 4/1955 | Hooker | 5/200.1 |
| 2,924,832 | A | | 2/1960 | Knowles | |
| 3,300,829 | A | | 1/1967 | Hegman et al. | |
| 3,546,725 | A | * | 12/1970 | Tambascio | 5/200.1 |
| 3,636,574 | A | | 1/1972 | Kramer | |
| 3,784,992 | A | | 1/1974 | Galiani | |
| 3,805,367 | A | | 4/1974 | Hastu | |
| 3,881,202 | A | * | 5/1975 | Thanic | 5/200.1 |
| 4,016,612 | A | | 4/1977 | Barile, Sr. | |
| 4,044,436 | A | | 8/1977 | Patrick | |
| 4,187,578 | A | * | 2/1980 | Little | 29/525.01 |
| 4,276,665 | A | * | 7/1981 | Mis | 5/201 |
| 4,468,946 | A | | 9/1984 | Driear | |
| 4,586,310 | A | * | 5/1986 | Baril et al. | 29/897 |
| 4,881,306 | A | | 11/1989 | Ernat et al. | |
| 5,477,571 | A | * | 12/1995 | Roggenkamp et al. | 5/200.1 |
| 5,501,053 | A | | 3/1996 | Goleby | |
| 5,628,114 | A | * | 5/1997 | Stern | 29/897.312 |
| 5,718,142 | A | | 2/1998 | Ferraro | |
| 6,170,217 | B1 | * | 1/2001 | Meyer | 29/897.31 |

FOREIGN PATENT DOCUMENTS

| | | |
|---|---|---|
| GB | 2077579 | 12/1981 |

* cited by examiner

*Primary Examiner*—Lynne H. Browne
*Assistant Examiner*—James M. Hewitt
(74) *Attorney, Agent, or Firm*—Suelthaus & Walsh, P.C.

(57) ABSTRACT

A frame apparatus made of two side frames and four interlocking cross arm supports, held together with a locking member with leg support feature. This configuration provides a frame apparatus that is less complex to assemble, and when the components are in place and locked together, the shape of the frame apparatus will not become distorted. In a preferred embodiment the frame apparatus is used as a bed frame.

21 Claims, 10 Drawing Sheets

FRAME APPARATUS

BACKGROUND OF THE INVENTION

The technical field of the invention relates in general to a frame apparatus and pertains, more particularly, to a frame for use as a bed frame directed to the structure, construction, and assembly of the frame. The frame of this invention is an improvement over a conventional frame constructed from side rails, their respective cross-arm supports, and one or more members used in frame assembly.

With the conventional frame, it is generally necessary to manufacture the components for constructing and assembling a bed frame for supporting a box spring and a mattress from angle members, cross-arm supports, and one or more rivets. This assembly includes two side rails and each of these two side rails has at least two cross-arm supports.

In the conventional frame, each cross-arm support attaches to an underside of one of the two side rails by one of the rivets. Additionally, the spacing of shoulder rivets on each of the cross-arm supports matches keyhole slots in each of the opposing cross-arm supports and provides for spacing the side rails to assemble a frame arrangement to fit either a double size or a queen size box spring and mattress.

Rivets, typically two or more per leg, attach the respective leg to the cross-arm supports of the conventional frame used for supporting a box spring and a mattress. The axes of these rivets typically lie in a horizontal plane resulting in a shear force load on these leg rivets.

Many manufacturers consider this drawback a weak link inherent in conventional bed frame construction. Use of conventional solid angle iron in one form or another for side rails and cross-arm supports is considered another drawback in that this adds weight (and therefore costs) to the manufacture of bed frames as well as complexity to the assembly of the bed frame.

The technical problems addressed by the invention include how to reduce the weight of individual members of the frame apparatus, strengthen an assembled frame apparatus, reduce the complexity of assembling the frame apparatus, reduce the cost to manufacture the frame members, and increase the versatility of the frame apparatus.

SUMMARY OF THE INVENTION

The technical character of the invention includes the provision of frame apparatus structural members having an improved strength to weight ratio, providing an improved arrangement of load bearing members of the frame apparatus that utilizes the strengths of these load bearing members, and providing an improved locking mechanism for assembling a frame of the invention from the component members of the invention.

Accordingly, it is an object of the invention to provide an improved frame apparatus that is adapted to form a unique configuration. With the frame apparatus of this invention, a formed sheet metal configuration provides an improved shape and strength combination compatible with standard headboard, footboard, and leg component configurations.

Another object of the invention is to provide an improved frame apparatus and constituent members that are constructed with a roll-formed coil sheet metal. This invention is intended to replace the angle iron used in conventional bed frame construction with roll-formed coil metal, which would be steel in a preferred embodiment, that is unique in shape and form and suitable for use with products and apparatus in addition to the frame apparatus described herein.

Another object of the invention is to provide a frame apparatus and constituent members of the frame apparatus that are adapted to provide a shape and form with improved structural strength beyond a given raw gauge metal manufacturer's specifications. In a preferred embodiment, a thin gauge coil sheet steel is disclosed that provides structural strength beyond a given raw gauge steel manufacture's specifications.

Another object of the invention is to provide a frame apparatus that provides an economical replacement for angle iron used in conventional bed frame construction of side rails and cross arm supports. The frame apparatus of this invention replaces conventional angle iron and provides, therefore, a considerable reduction in weight per foot of linear length.

Another object of the invention is to provide an improved frame apparatus and constituent members adapted for providing an improved locking arrangement between side rails and cross-arms. The frame apparatus of this invention includes a locking arrangement between a cross-arm and a side rail that utilizes a lock-leg incorporating a cam-lock.

Another object of the invention is to provide a frame apparatus that incorporates a lock-leg intermediate a side rail and a cross-arm. The lock-leg incorporates a cam-lock that resists the distortion of an assembled frame apparatus from a preferred rectangular shape into a trapezoidal shape as a result of forces acting from any direction on the frame apparatus. The frame apparatus remains in a squared condition even without a headboard or a footboard attachment.

Another object of the invention is to provide a frame apparatus in which metal weight is reduced, thereby reducing the cost of the frame apparatus. In a preferred embodiment the invention takes advantage of a reduction in the weight and cost of steel used to manufacture the frame apparatus.

Another object of the invention is to provide a frame apparatus and constituent members that lend themselves to high speed and automated manufacturing methods as well as reduced labor-intensive material handling during manufacturing. Coil sheet metal (steel in a preferred embodiment) is available pre-coated with rust inhibitor, plated, or prepainted coating prior to forming and notching, thereby eliminating the need to paint the frame apparatus.

Another object of the invention is to provide a frame apparatus that can be shipped in smaller packages at less cost.

To accomplish the foregoing and other objects as well as present technical contributions of the invention, there is provided a frame apparatus and constituent members for assembling the frame apparatus. The frame apparatus comprises opposing side rails, cross-arms connected to their respective side rails, and locking members (referred to above as the lock-leg in a preferred embodiment).

Each locking member can include a cam-lock, and, in a preferred embodiment, each locking member includes the cam-lock. An attachment member, preferably located on an associated cross-arm, cooperates with the cam-lock on the locking member to lock and secure the cross-arm in position such that the connection of associated cross-arms forms an assembled frame apparatus of this invention.

In the disclosed embodiment a roll-formed, thin gauge coil sheet metal, preferably steel, replaces the angle iron members of a conventional frame apparatus. A lock-leg member incorporates a cam-lock element.

When the cam-lock element engages the cross-arm, the lock-leg forms an angle of approximately 450° with the associated cross-arm and the side rail. The combination of the lock-leg, cross-arm, and side rail in this locked position inhibits the distortion of the frame apparatus from the desired rectangular shape into a trapezoidal shape.

These and other objects, features, and technical contributions of the invention will be better understood and appreciated from the following detailed description of embodiments, including preferred embodiment thereof, selected for purposes of illustration and shown in the accompanying drawings.

DETAILED DESCRIPTION

Figure 1:
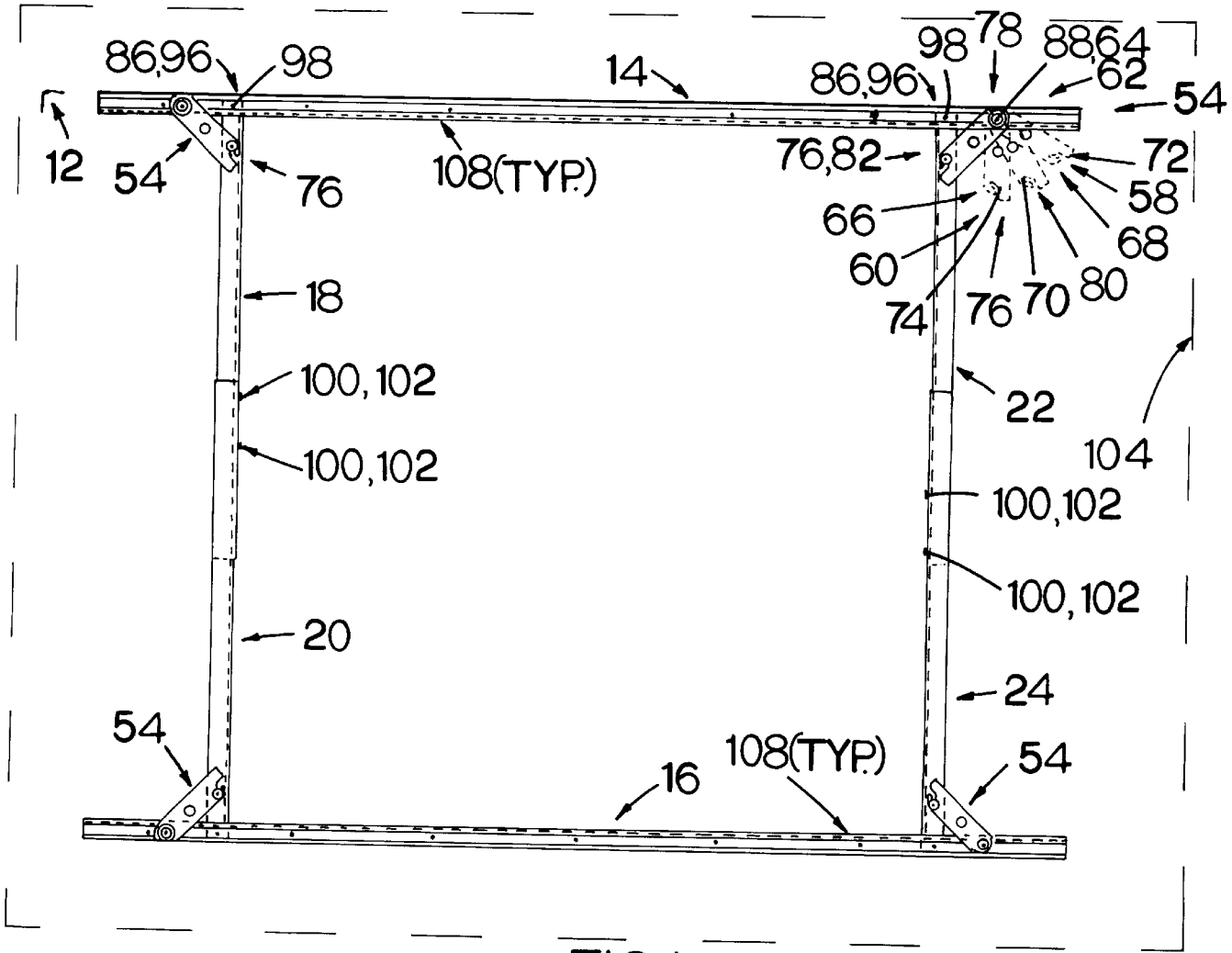
FIG. 1 is a top plan view of a frame apparatus constructed in accordance with the invention.
Figure 2:
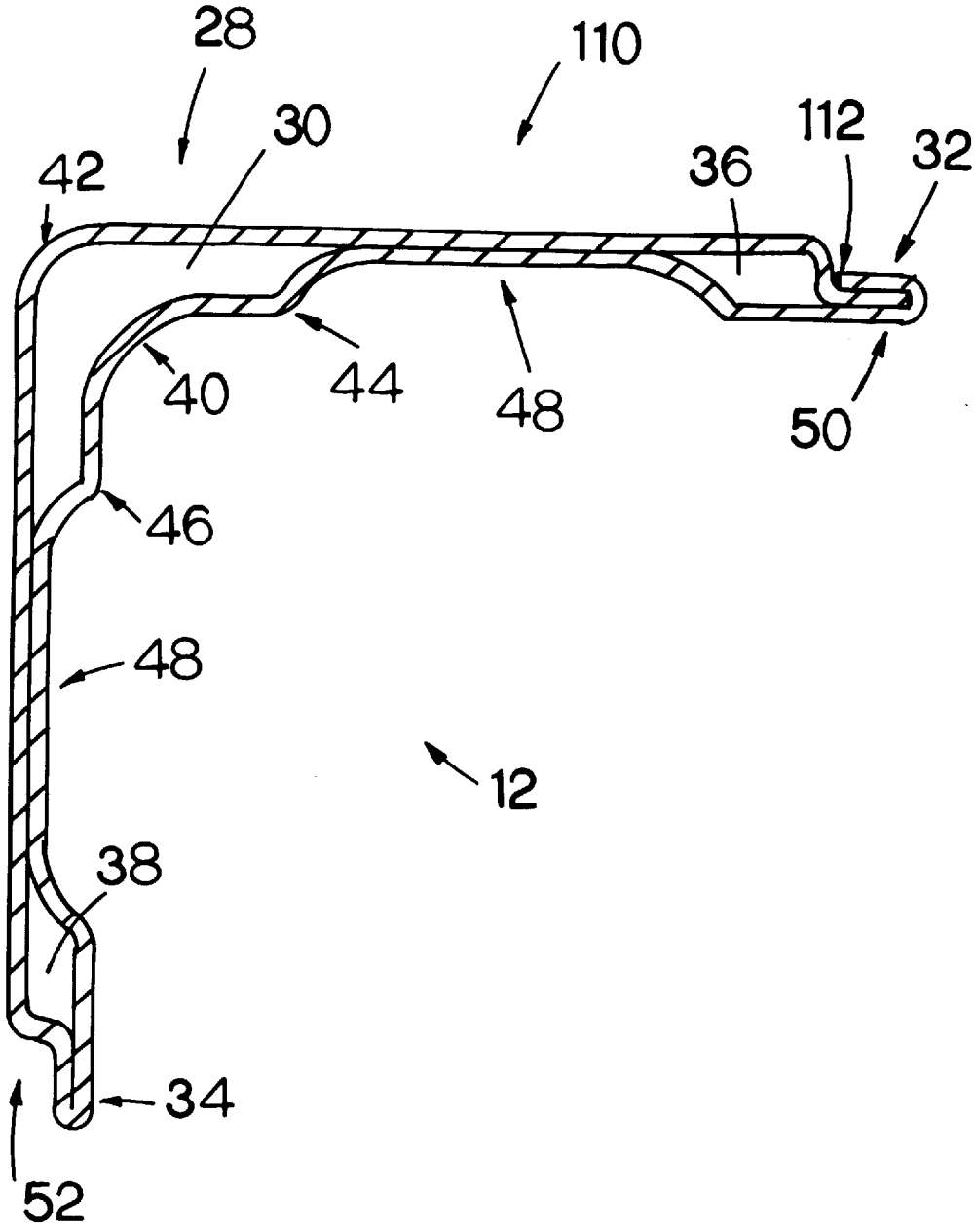
FIG. 2 is a side elevation and cross-section of a single seam embodiment of a structural member of the invention.
Figure 3:
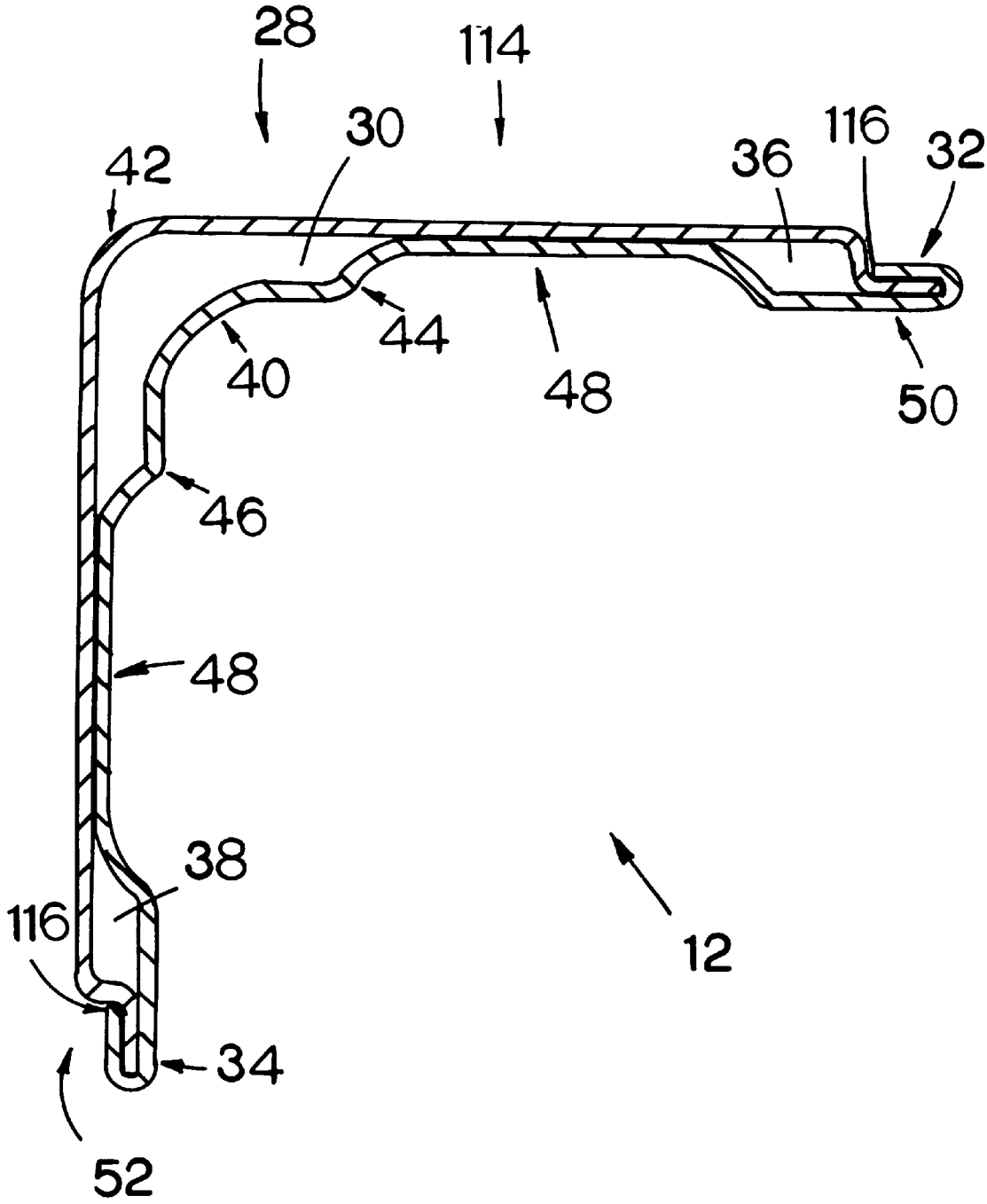
FIG. 3 is a side elevation and cross-section of a double seam embodiment of a structural member of the invention.
Figures 4, 5:
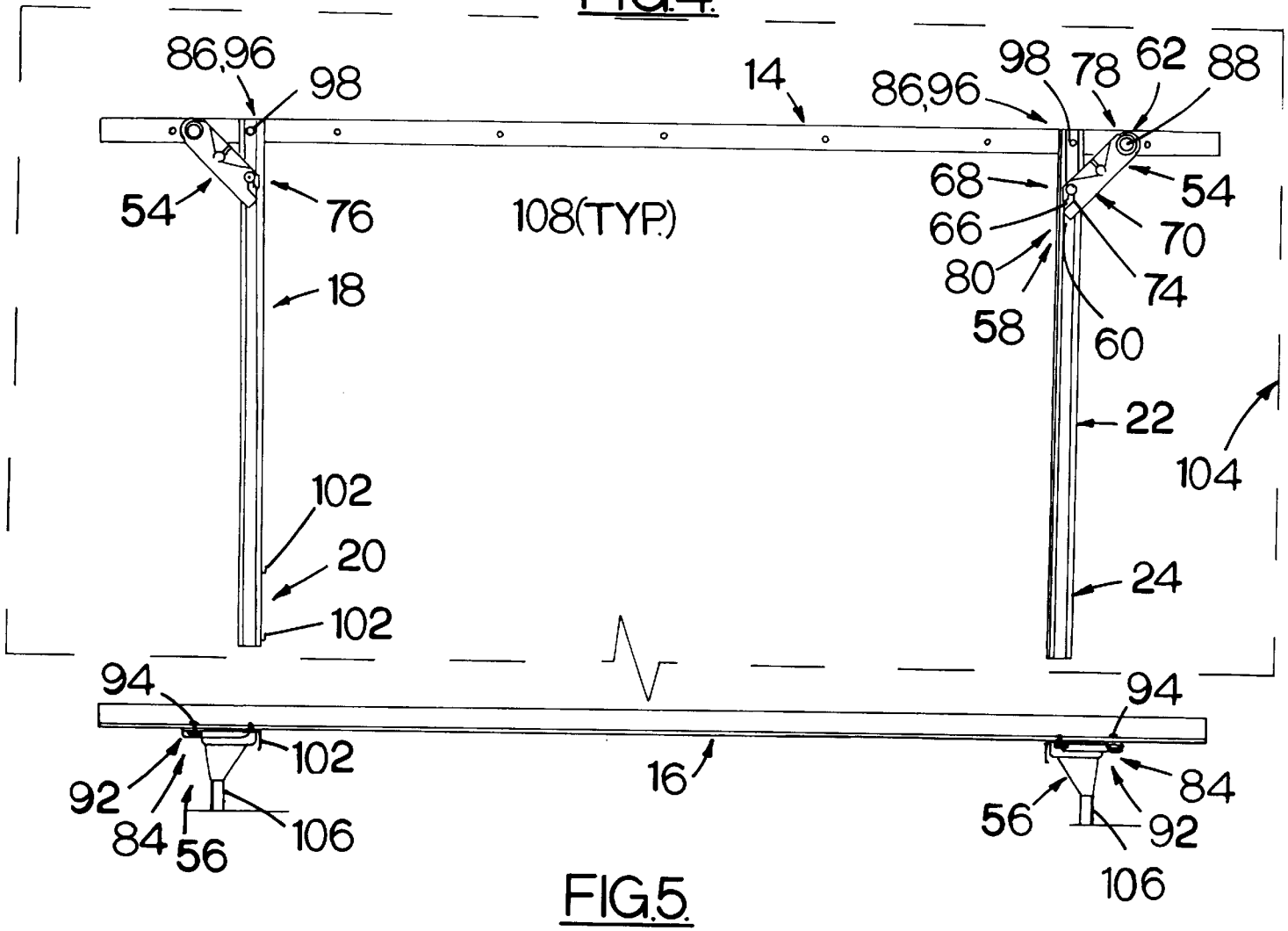
FIG. 4 is a bottom view of a frame apparatus of the invention.
FIG. 5 is a side elevation of a frame apparatus depicted in FIG. 4.
Figures 6, 7:
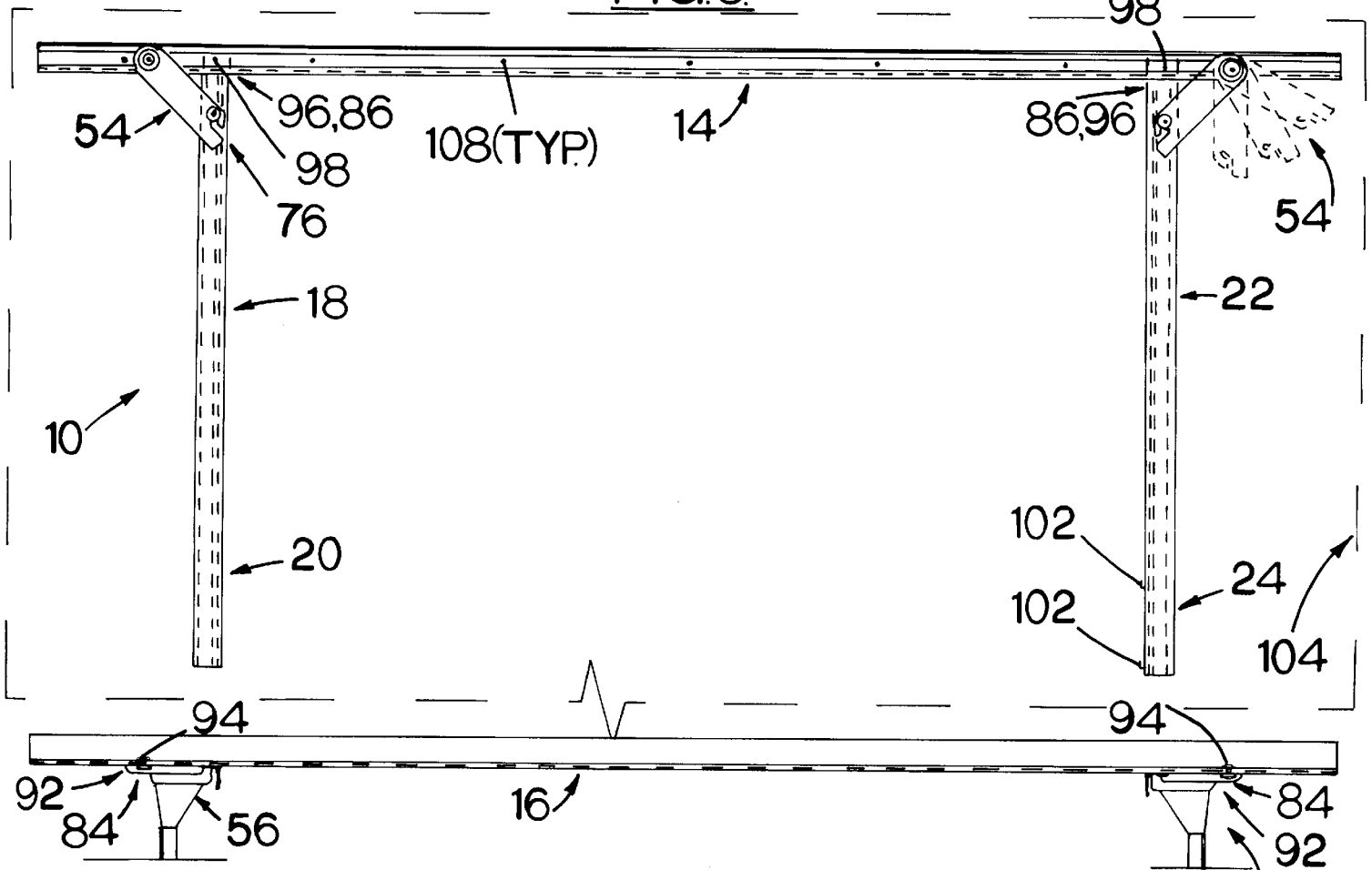
FIG. 6 is a top view of a frame apparatus of the invention.
FIG. 7 is a side elevation of a frame apparatus depicted in FIG. 6.
Figure 8:
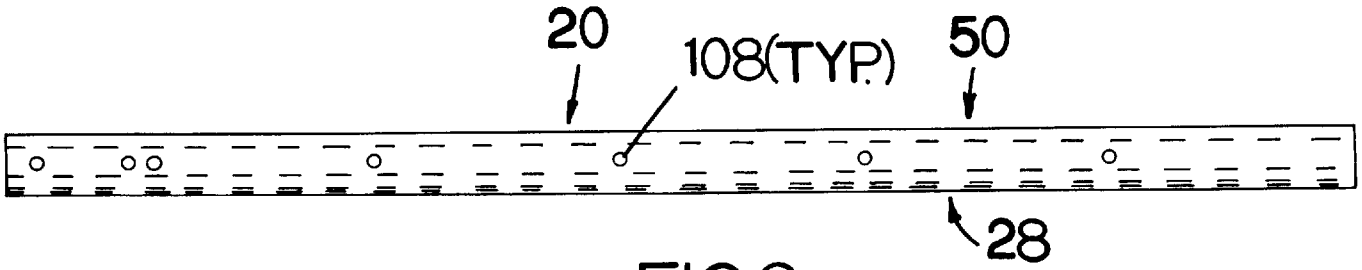
FIGS. 8 and 9 are elevations of a structural member of the invention.
Figure 9:
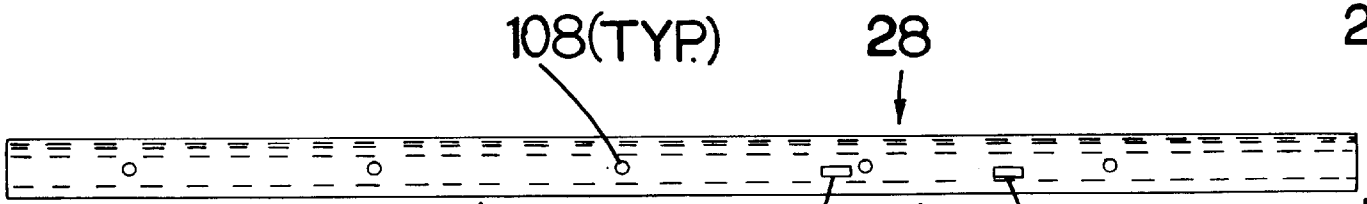
Figure 10:
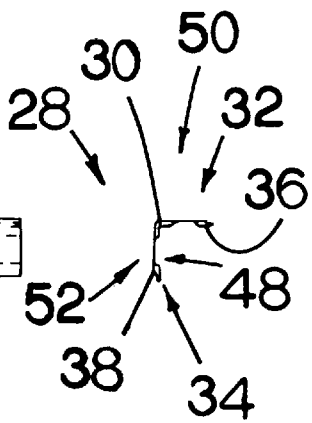
FIG. 10 is a cross section of the structural member depicted in FIGS. 8 and 9.
Figure 12:
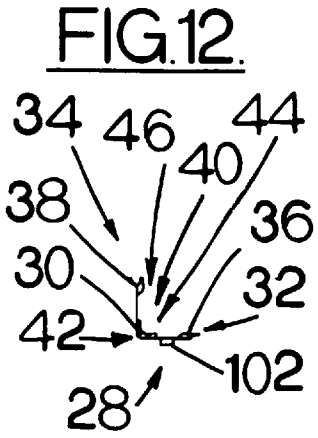
FIGS. 12 and 14 are cross sections of the structural members depicted in FIGS. 11 and 13.
Figure 14:
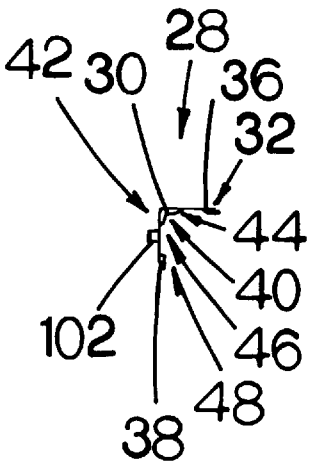
Figure 11:
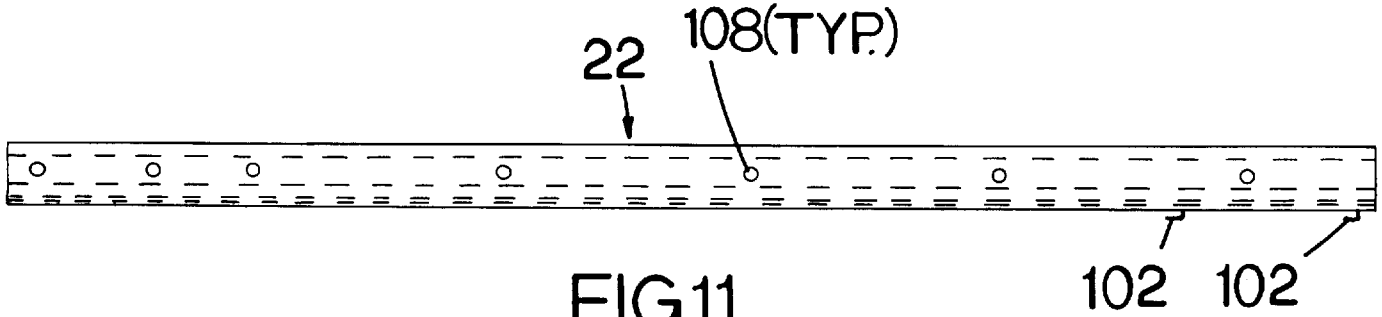
FIGS. 11 and 13 are elevations of a structural member of the invention.
Figure 13:
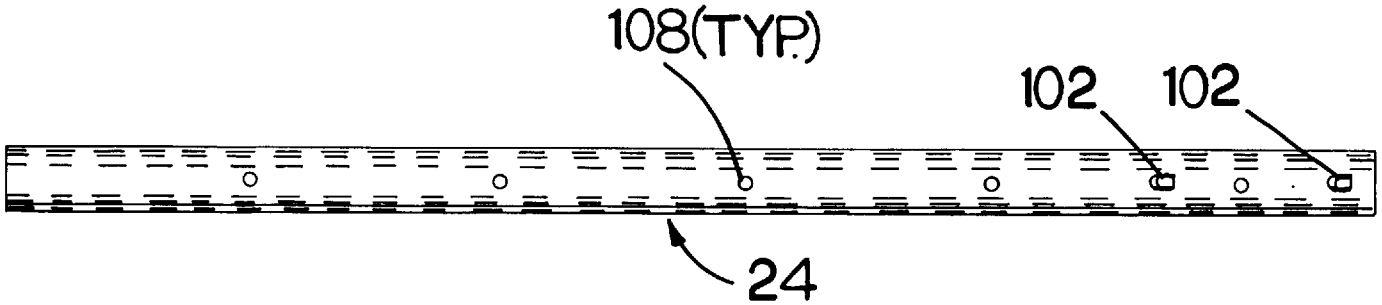
Figure 15A:
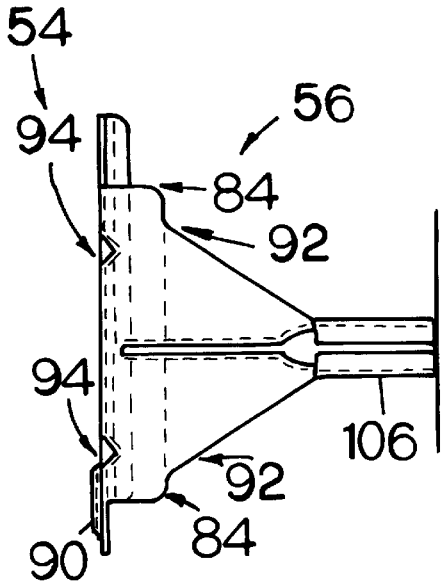
FIGS. 15(*a–e*) and 16(*a–e*) are plan views and elevations of a locking member and a leg portion of a preferred embodiment of the invention.
Figure 15B:
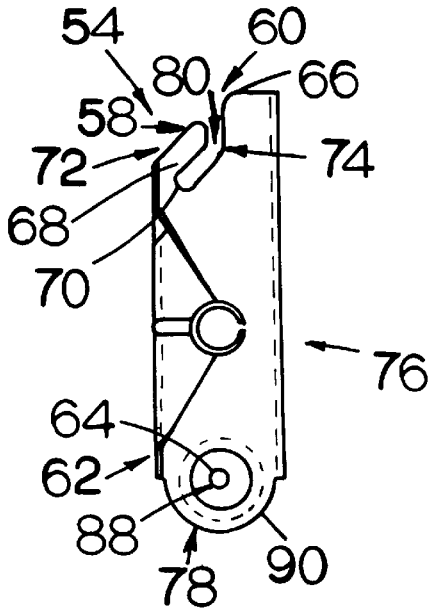
Figure 15C:
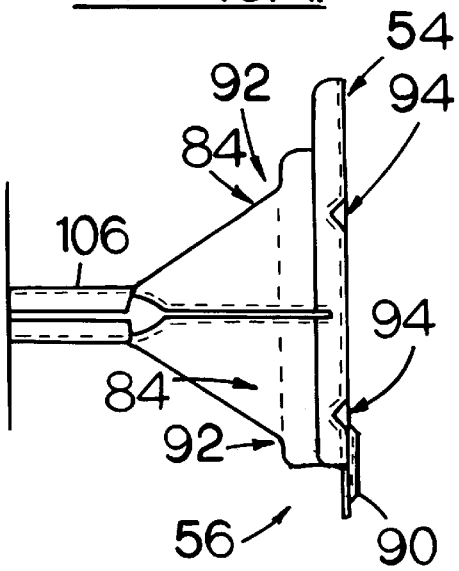
Figure 15D:
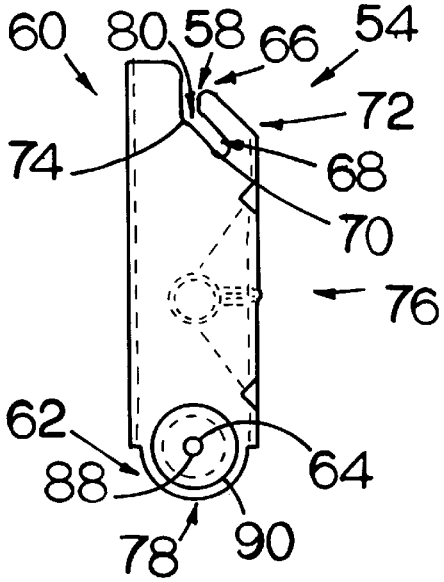
Figure 15E:
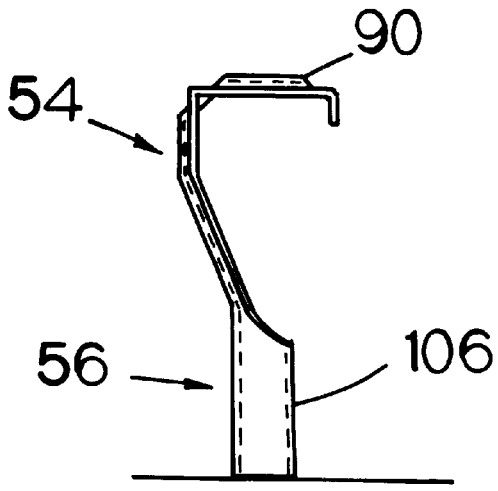
Figure 16E:
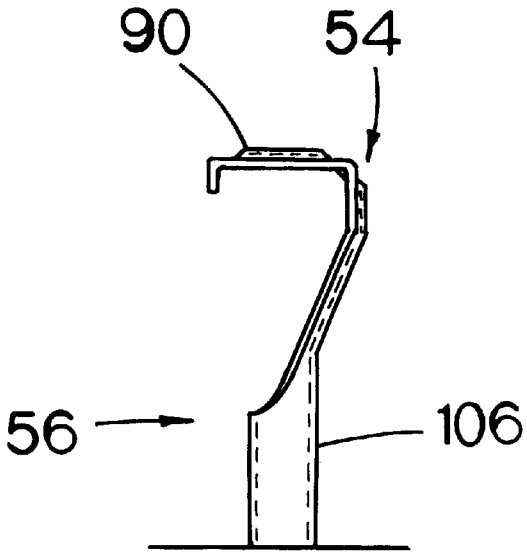
Figure 16B:
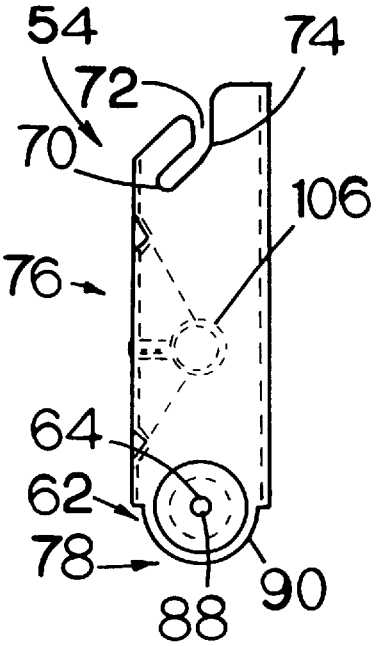
Figure 16A:
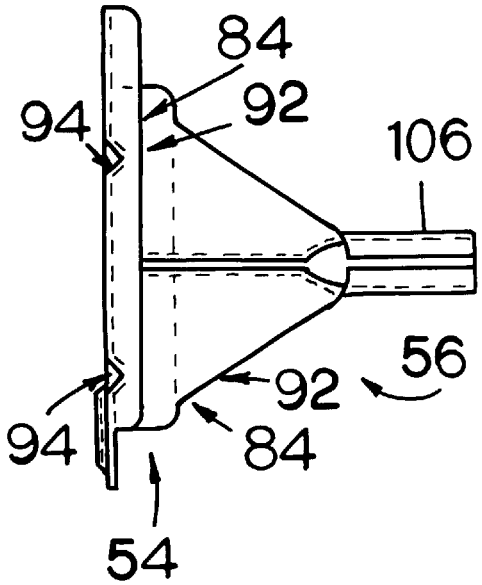
Figure 16D:
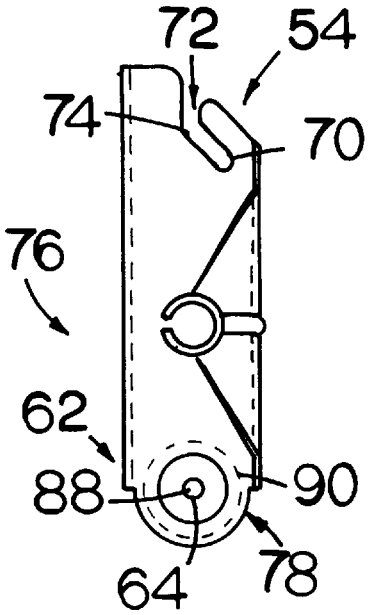
Figure 16C:
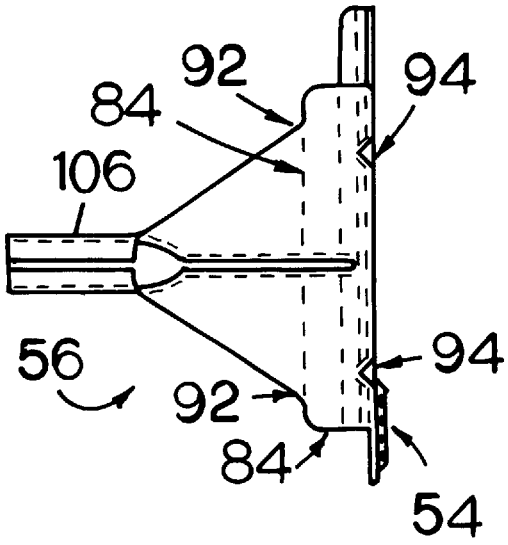

Referring now to the drawings there is shown a preferred embodiment for the frame apparatus and structural members of this invention, including the technical features of this invention for which protection is sought. The frame apparatus and structural members are described in connection with a bed frame.

The frame apparatus of the invention is particularly adapted for providing frame apparatus structural members with an improved strength to weight ratio, providing an improved arrangement of load bearing members of the frame apparatus that utilizes the strengths of these load bearing members, and providing an improved locking mechanism for assembling a frame of the invention from the component members of the invention including the improved structural members described and illustrated.

The drawings show a frame apparatus 10 constructed as a bed frame. It will be understood by one of ordinary skill in the art that the frame apparatus 10 is suitable for use, with or without leg extensions (described below), as a frame for supporting a variety of loads, not just a box spring, a mattress, or both when used as a bed frame.

The frame apparatus includes a number of structural members 12, including side rails 14, 16 and cross-arms 18, 20 and 22, 24. These structural members provide a substitute for conventional solid angle members and are preferred for use with the frame apparatus of this invention.

The construction of one structural member will now be described. Except as otherwise noted herein or on the accompanying drawings or illustrated in the accompanying drawings, the structural members are similar in the overall arrangement of a sheet material 26 as generally described below.

The structural member 12 includes the sheet material 26 formed into an angled structural member (e.g., 14, 16, 18, 20, 22, and 24). The sheet material is formed into a plurality of sections. In a preferred embodiment a single sheet of material is used to form the structural member 12 and incorporates a known sheet metal forming technique (discussed below) to connect the adjacent layers of the sheet material 26 and thereby lock together adjacent layers of the sheet material forming the structural member.

A corner section 28 of the structural member formed from the sheet material 26 creates a generally tubular sub-member 30. A first distal section or flange 32 and a second distal section or flange 34 includes a first hollow portion 36 and a second hollow portion 38, respectively. In a preferred embodiment the corner section tubular sub-member 30 is formed using a plurality of radii 40, 42 and bends 44, 46.

The structural member of this invention opposes bending. Once the arrangement of the sheet material 26 of this invention is understood, it will be recognized by one skilled in the art that other shapes and forms can be utilized to manufacture a structural member in accordance with the teaching and technical contributions of this invention and within the scope of the allowed claims.

The drawings illustrate a preferred embodiment of the invention in which the structural members 14, 16, 18, 20, 22, and 24 form right angle structural members.

At least one of the distal sections or flanges 32, 34 (and both distal sections and flanges in a preferred embodiment illustrated in the drawings) of structural member 12 includes a recessed pocket member 48 located intermediate the corner section 28 and an edge 50 or 52 of the structural member 12. The recessed pocket in the illustrated embodiment extends the length of the structural member 12 and is a preferred location for the placement or positioning of a variety of fasteners, openings, tangs, and cam-lock member related elements described herein.

A locking member 54 is provided for locking the relative position of one side rail 14 or 16 to its respective cross-arm 18, 20 or 22, 24. Since a preferred embodiment of the locking member 54 includes a leg or support portion, member, or element 56, this element will be referred to as the lock-leg or the cam-lock leg for purposes of consistency, but it will be understood that variations of the preferred embodiment described, illustrated, and claimed herein are still within the scope and technical contributions of the invention.

A cam-lock feature of the invention is provided for securing the side rail and the cross-rail in position in order to assemble the frame apparatus. The cam-lock feature incorporates a slot 58 proximate an end 60 of the locking member 54.

The locking member rotates about a pivot point 62. A rivet 64 provides the ability of the locking member to pivot in a preferred embodiment.

The slot 58 has an opening 66 leading to a channel 68 providing a cam-operating slot. In a preferred embodiment, the channel extends from the opening 66 to a channel end 70 and the path 72 from the channel opening 66 to the channel end 70 includes a bend 74.

It will be understood that the path of the channel requires this bend or some other appropriate bend or shape in order for the locking member to function as described herein as a cam-operating slot in cooperation with a cam member 76.

The channel 68 cooperates with and pivots at an end 78 of the locking member 54. The locking member 54 pivots relative to its respective side to engage cam member 76 so as to lock the respective cross-rail in place relative to the side rail. In a preferred embodiment, the locking member 54 forms a forty-five degree angle with the respective side rail and cross-arm.

In one embodiment of the invention the locking member 54 or locking-leg member includes the leg or support portion 56. In a preferred embodiment, this leg 56 is formed from a single sheet of structural material, for example, 16-gauge steel.

The cam-lock leg or lock-leg or locking member 54 manufacture or fabrication allows locking member 54 and any associated support or leg or support portion 56 all to be mounted under the associated side rail structural member. In a preferred embodiment, the locking member 54 attaches at the one end 78. The end 60 of locking member 54 is the location of the opening 66 of slot 58 and the locking member preferably has a flat upper surface. As the locking member 54 is rotated about the pivot point 62, the opening 66 of the channel 68 (an angled slot 80 or cam-operating slot in a preferred embodiment) can be made to capture the cam member 76, preferably a shoulder rivet 82, depending from the bottom of the respective cross-arm such that shear forces do not act on the rivet and compression forces do act on the rivet.

The cross-arms are preferably mounted to the under side of the side rail bar with other cross-arm fasteners 84, which are also shoulder rivets in a preferred embodiment. A pivot location 86 of the cross-arm 18, 20, 22, 24 is spaced so that when both cross-arms 18, 20 or 22, 24 and respective cam-lock legs or locking members 54 are rotated toward each other, the cam slot or channel 68 engages the respective shoulder rivet 82 and the respective cross-arm moves toward and becomes locked or held in a desired position relative to the respective side rail 14 or 16, that is, in a ninety degree locked position.

The invention can be stored or shipped (not shown) with both locking members 54 and cross-arms parallel to the respective side rail. This position provides a profile or silhouette that allows a reduction in required storage space of the package size.

It will be understood by one of ordinary skill in the art that the preferred embodiment of the invention requires a left-hand and a right-hand leg 56. The leg of the preferred embodiment of the present invention, however, is identical for all four legs 56.

Manufacturing a structural member 12 includes forming the angled structural member 12 from the sheet of material 26 and forming the angled structural member 12 into a plurality of sections, tubular sub-members, and at least one distal hollow portion. The structural member formed in accordance with the invention opposes bending.

While the single thickness sheet material 26 is preferred, it will be understood that multiple thickness sheet material may be available and used as a substitute.

In operation, in assembling the frame apparatus 10, the shoulder rivet 64 attaches to the underside of the cross-arm 18, 20, 22, 24 at a distance from a pivot location 92 provided by a hole and rivet 94 at the end of the cross-arm which is substantially equal to the distance between a pivot location 96 provided by a hole and a rivet 98 in the side rail 14, 16 and the fixed pivot point 62 of the cam-lock leg or locking member 54.

Each pair of cross-arms attaches to its respective side rail so that when the cam-lock leg or locking member 54 and the respective cross-arm support rotate toward each other, it will cause the channel or cam-lock slot 68 on the locking member (and leg in a preferred embodiment) to engage the open shoulder rivet or screw that functions as the cam member 76 on the cross-arm and lock the cross-arm at a right angle to the respective side rail.

In a preferred embodiment, each cross-arm has either a set of slots 100 or a complementary set of tangs 102. The tangs slip into the respective slots, thereby providing adjustability of the size of an assembled frame for either a double bed or a queen sized-bed box spring and mattress.

The frame apparatus 10 or its equivalent is now assembled. One skilled in the art will understand that all rivets and similar or equivalent fasteners subjected to a downward loading are in compression, not shear.

It will now be a matter understood by one skilled in the art to program a roll-forming mill to allow for changes in the position and location of the tang slots in order to fabricate a frame apparatus 10 suitable for single or king size bed frames. (Note that the drawings illustrate only double and queen size bed frames.)

In a preferred embodiment the structural members have load capabilities equivalent to those of an angle iron having similar dimensions. Preferably, a frame apparatus of this invention intended for use in place of a conventional bed frame has structural members formed from a 22-gauge sheet metal. It will be understood by one of ordinary skill in the art how to scale the thickness and size of the structural members to suit a particular application.

In a preferred embodiment the layers of the sheet metal material form the structural members 12. At certain intervals where the layers of sheet metal material are drawn back against each other (i.e., where the sheet metal material is drawn or rolled back against itself) and abut each other, the two layers are locked together by means of a known system called "TOGGLE-LOCK."

At the corner of the right angle formed in the structural member between the distal ends or flanges, the tubular-shaped sub-member is formed using radii of different sizes to construct structural strength that oppose outward bending of the ninety degree right angle generated between the two flanges. This particular design specifies 22-gauge (0.030). The cross section, size, and gauge of material can be considerably different, depending on the specific application.

In the preferred embodiment illustrated in the drawings and described herein, the lock-leg 54 forms upside-down "U" channel with a tapered extension 56 extending downward and rolled together to capture a roller or glide stem (not shown) at the distal end of the leg or other suitable support portion.

The lock-leg 54 includes a hole 88 centered in a circular boss 90 on one end of the "U" locking member 54. The boss receives the shoulder rivet 64 on which locking member 54 pivots or rotates through three hundred sixty degrees. It should be noted that washers (not shown) are typically used wherever one of the members of the frame apparatus 10 moves relative to another member of the frame apparatus.

The circular boss provides stiffening to that part of the top of the locking member that extends beyond the "U" channel. The opposite end of the "U" channel incorporates the angled slot 80 designed to receive the shoulder rivet 82 through sliding cam action.

From the foregoing description, those skilled in the art will appreciate that all of the objects and technical contributions of the invention are realized. When the four cross-arms are slipped together to form a completed frame assembly, the locking member or cam-lock leg effect will not allow the frame to be forced into a trapezoidal shape as a result of any forces applied from any direction. The frame will remain in a squared condition even without head-board/foot-board attachments.

The frame apparatus structural members have an improved strength to weight ratio, providing an improved arrangement of load bearing members of the frame apparatus that utilizes the strengths of these load-bearing members, and provide an improved locking mechanism for assembling a frame of the invention from the component members of the invention. A formed sheet metal configuration provides an improved shape and strength combination compatible with standard headboard, footboard, and leg component configurations.

The improved frame apparatus and constituent members are constructed with a roll-formed coil sheet metal of preferably either one or two layers. Thus the invention is used to replace the angle iron used in conventional bed frame construction with roll-formed coil metal, preferably steel, having a unique shape and form. It will be understood that the structural member of this invention is not limited to use in bed frames, rather the structural member of this invention is suitable for use as a substitute for a structural member or members.

The frame apparatus and constituent members of the frame apparatus are adapted to provide a shape and form with improved structural strength beyond a given raw gauge metal manufacturer's specifications. In a preferred embodiment, a thin gauge coil sheet steel is disclosed that provides structural strength beyond a given raw gauge steel manufacture's specifications and the structural member can be manufactured from either one or two or more layers of the sheet material. The drawings illustrate a one sheet and a two sheet embodiment.

The frame apparatus provides an economical replacement for angle iron used in conventional bed frame construction of side rails and cross arm supports. The frame apparatus of this invention replaces conventional angle iron and provides, therefore, a considerable reduction in weight per foot of linear length.

The improved frame apparatus and constituent members provide an improved locking arrangement between side rails and cross-arms. The frame apparatus includes a locking arrangement between a cross-arm and a side rail that utilizes a lock-leg incorporating a cam-lock.

The frame apparatus incorporates a lock-leg intermediate, a side rail, and a cross-arm. The lock-leg incorporates a cam-lock that resists distortion of an assembled frame apparatus from a preferred rectangular shape into a trapezoidal shape as a result of forces acting from any direction on the frame apparatus. The frame apparatus remains in a squared condition even without a headboard or a footboard attachment.

The frame apparatus incorporates structural members, in which metal weight is reduced, thereby reducing the cost of the frame apparatus. A preferred embodiment the invention takes advantage of a reduction in the weight and cost of steel used to manufacture the frame apparatus.

The frame apparatus and constituent members lend themselves to high speed and automated manufacturing methods and reduced labor intensive material handling during manufacturing whether one or two sheets are used to form the structural member. Coil sheet metal (steel in a preferred embodiment) is available pre-coated with rust inhibitor, plated, or pre-painted coating prior to forming and notching, thereby eliminating the need to paint the frame apparatus.

The frame apparatus can be shipped in smaller packages at less cost.

The locking member 54 and the structural members can be manufactured from a single sheet of material.

While specific embodiments have been shown and described, many variations are possible. While one and one half by one and one half inch by 22-gauge (0.030) has been described, many combinations of gauge and size could be used in various combination for other suitable applications, particularly where a right angle structural member is desired. Weight and economy can be balanced with load requirements.

The drawings illustrate an outline of a box spring and mattress 104 in order to further illustrate the bed frame embodiment of the invention. When used as a bed frame or other frame apparatus, lower portions 106 of leg portion 56 or locking member 54 may receive a caster, roller, or other foot member (not shown) as suits the application.

The lower portion 106 is only illustrated without any additional member inserted therein for purposes of clarity and the availability of a variety of rollers, casters, and the like will be understood by one of ordinary skill in the art. For purposes of clarity, typical locations of the "TOGGLE-LOCK" protrusions are indicated at 108.

The invention has been described for use as a bed frame. However, it should now be understood by one of skill in the art that the invention, and, in particular, its replacement of conventional angle iron, has other applications as a substitute for angle iron. It has been shown that the bed frame application of the invention uses 22-gauge (0.030) steel that provides essentially the strength of one and half inch by one and one half inch by three-sixteenths angle iron. In a preferred embodiment of the invention, roll-formed coil sheet steel is formed in a manner that a right angle shape one and one half by one and one half inches (in this application) closely resembles standard angle iron of that same size.

In a preferred embodiment the structural member 12 is formed from a single sheet of material forming a single seam embodiment 110 in which a single sheet of material is rolled and bent to form the structural member with a single seam 112. Another preferred embodiment of the invention is illustrated at 114 in which two sheets of material are used to manufacture structural apparatus 12 with double seams 116. This preferred embodiment provides all of the advantages of the invention and is expected to cost less to manufacture due to the use of the double seam 116.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of the invention be determined by the appended claims and their equivalents.

What is claimed is:

1. A method of constructing a railing or a cross-arm of a bed frame, which comprises the steps of:

forming an angled structural member from a sheet of material, wherein the angled structural member forms a substantially right angle;

forming the angled structural member into a plurality of sections, where one of the sections is a corner section comprising a tabular sub-member formed from a plurality of radii in the angled structural member;

forming a first distal section into a first hollow portion;

forming a second distal section into a second hollow portion; thereby forming the structural member so as to oppose bending of the structural member.

2. A method as set forth in claim 1, which comprises forming the structural member from a single sheet of material.

3. A method as set forth in claim 2, which comprises forming the structural member from the single sheet of material so as to form the structural member into a plurality of layers.

4. A method as set forth in claim 3, which comprises locking pairs of adjacent layers together.

5. A method as set forth in claim 1, which comprises forming at least one of the distal sections of the angled structural member into a recessed pocket intermediate the corner section and an edge of the structural member.

6. A method as set forth in claim 1, which comprises forming a structural member having structural capabilities equivalent to those of an angle iron having similar dimensions.

7. A method as set forth in claim 1, which comprises forming the structural member from a 22 gauge sheet metal.

8. A method as set forth in claim 1, which comprises forming a locking member for connecting pairs of frame members.

9. A method as set forth in claim 1, which comprises forming the frame from at least two structural members placed at an angle.

10. A method as set forth in claim 9, which comprises forming the frame from at least two structural members placed at right angles.

11. A method as set forth in claim 1, which comprises forming a locking member for connecting pairs of frame members; and including a frame support leg with the locking member.

12. A method as set forth in claim 1, which comprises forming a bed frame.

13. A method as set forth in claim 12, which comprises forming the bed frame from a pair of structural members and a pair of cross arm members.

14. A method of constructing a frame, which comprises the steps of:

forming an angled structural member from a sheet of material;

forming the angled structural member into a plurality of sections;

forming a comer section at a corner of the angled structural member into a tubular sub-member;

forming a first distal section into a first hollow portion;

forming a second distal section into a second hollow portion; thereby forming the structural member so as to oppose bending of the structural member, forming a locking member for connecting pairs of frame members; and attaching one of the locking members to one structural member for pivoting movement relative to the structural member.

15. A method as set forth in claim 14, which further comprises forming a slot in the locking member proximate one end and providing for pivoting of the locking member relative to the adjacent structural member at an opposing end.

16. A method as set forth in claim 14, which further comprises forming a slot proximate one end of the locking member and forming a slot proximate one end of the locking member and forming a pivot for movement of the locking member relative to the adjacent structural member at an opposing end.

17. A method as set forth in claim 16, which further comprises forming a cam operating slot in the locking member.

18. A method of constructing a bed frame, which comprises the steps of:

forming an angled structural member from a sheet of material;

forming the angled structural member into a plurality of sections;

forming a comer section at a comer of the angled structural member into a tubular sub-member;

forming a first distal section into a first hollow portion;

forming a second distal section into a second hollow portion; thereby forming the structural member so as to oppose bending of the structural member;

forming the bed frame from a pair of structural members and a pair of cross arm members;

forming a locking member for connecting the structural member to the associated cross arm member; and attaching one locking member to at least one of the pair of cross arm members for pivoting movement relative to at least one of the pair of structural member.

19. A method as set forth in claim 17, which further comprises forming a bed frame support leg from a single sheet of material.

20. A method as set forth in claim 19, which further comprises forming a bed frame support leg with the locking member.

21. A method as set forth in claim 20, which comprises forming the cam operating slot for engaging a cam member in a ninety degree locked position; and forming a forty-five degree angle between the locking member and an adjacent structural member and a cross arm member.

* * * * *